US005804260A

United States Patent [19]

Stafford

[11] Patent Number: 5,804,260

[45] Date of Patent: Sep. 8, 1998

[54] SPONGE COVERING FOR A WALL MOUNTED SOAP DISH

[76] Inventor: Robert Stafford, 1475 Cherokee Blvd., Eglin, S.C. 29045

[21] Appl. No.: 670,014

[22] Filed: Jun. 25, 1996

[51] Int. Cl.[6] ..... A63H 3/00

[52] U.S. Cl. ..... 428/15; 428/16; 428/36.8

[58] Field of Search ..... 428/7, 15, 16, 428/36.8

[56] References Cited

U.S. PATENT DOCUMENTS

| | | | |
|---|---|---|---|
| D. 277,146 | 1/1985 | Boroch | D6/540 |
| D. 349,794 | 8/1994 | Hayes, Jr. | D32/40 |
| D. 367,322 | 2/1996 | Parker et al. | D32/42 |
| 1,659,644 | 2/1928 | Vernet | 15/244.4 X |
| 1,660,729 | 2/1928 | Strock | 15/244.4 |
| 1,756,713 | 4/1930 | Vernet | 15/244.4 X |
| 1,908,017 | 5/1933 | Hebig | 15/244.4 X |
| 2,066,420 | 1/1937 | Reysa | 15/105 |

FOREIGN PATENT DOCUMENTS

| | | |
|---|---|---|
| 677403 | 8/1952 | United Kingdom . |

*Primary Examiner*—Henry F. Epstein

*Attorney, Agent, or Firm*—Tom Hamill, Jr.

[57] ABSTRACT

A sponge is provided which completely surrounds and envelopes a wall mounted soap bar holder or dish. The sponge has a top portion with a shaped aperture or depression to receive a bar of soap of a generally similar shape. The sponge also includes an opening or aperture on one of its sides which would receive the cantilevered element or tongue of the soap dish. The opening may extend up to and including the length of the side of the sponge in order to accommodate a similarly sized wall mounted soap bar holder. The opening would extend or penetrate through a portion of the sponge to fully enclose the wall mounted soap bar dish's cantilevered element. The sponge may be provided in any shape, and preferably may have the appearance of a geometric shape, seashell or other animal. The sponge may appear in any color. The sponge material may be provided in a range of porosities depending on size and application.

17 Claims, 9 Drawing Sheets

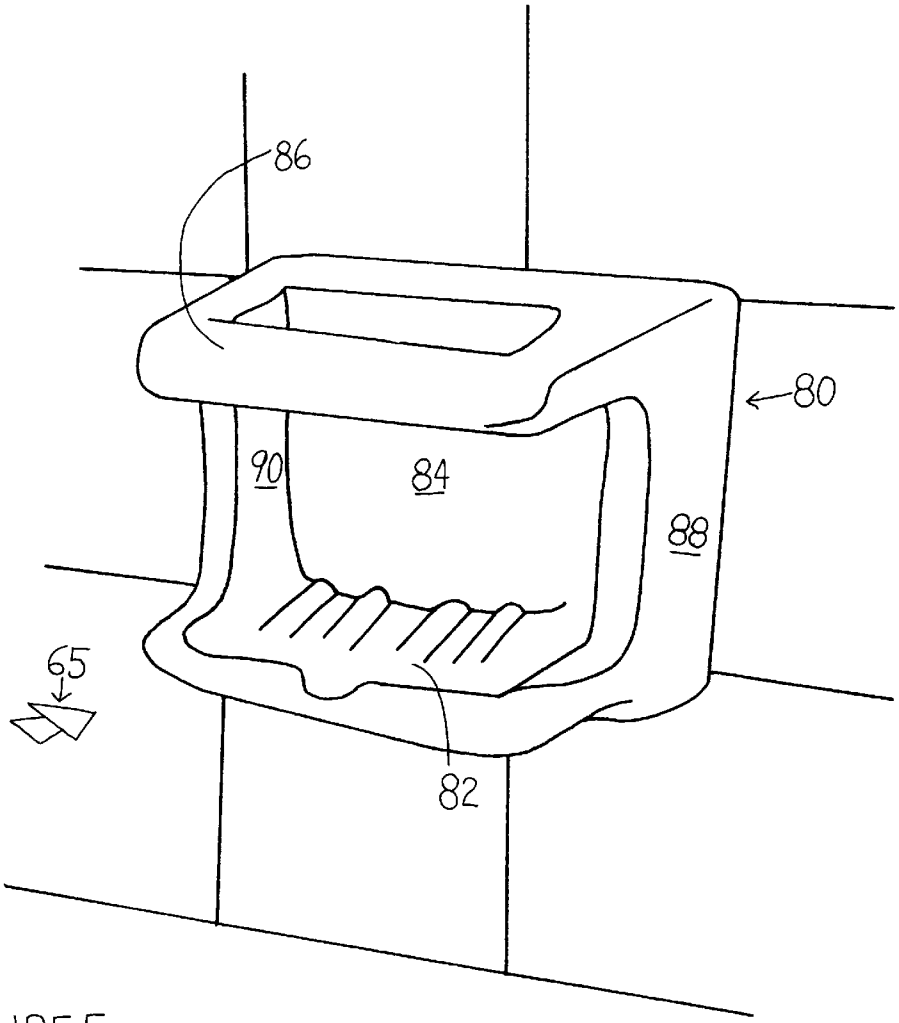
FIGURE 5
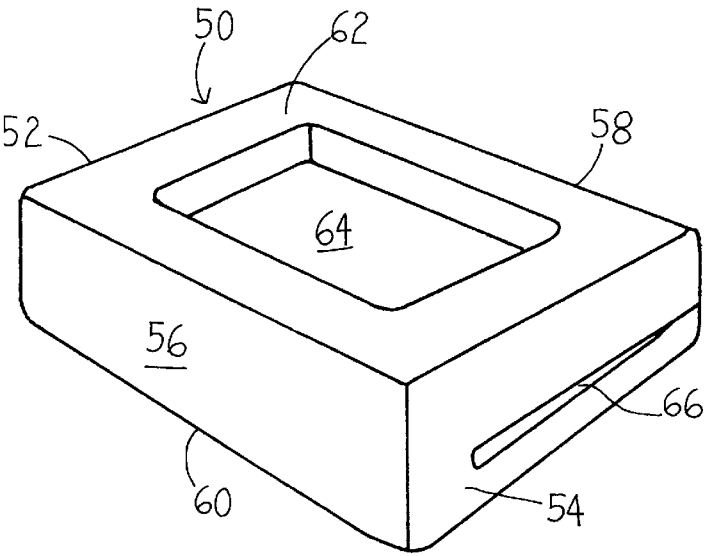

SPONGE COVERING FOR A WALL MOUNTED SOAP DISH

BACKGROUND OF THE INVENTION

1. Field of the Invention

The present invention relates generally to sponges and wall mounted soap bar holders, and more particularly, to a sponge which envelopes a wall mounted soap bar holder, the sponge further having a soap receiving or holding element located thereon.

2. Description of the Prior Art

Wall mounted soap bar holders are found near most sinks, showers and bathtubs. They are generally made from porcelain, fired clay, or plastic and are mounted to the wall by any of a variety of attachment means. In the wall mounted soap bar holders currently in use, the soap, after being used and still being wet, is returned to the dish. The moisture present on the soap together with other water which is splashed thereon, soon softens and dissolves the soap. Often, soap scum residue remains on and about the soap bar as well. With the subsequent evaporation of the water, a dirty, unsanitary, soap scum is left on the surface of the holder. This unsightly condition requires frequent cleaning in order to remove the aforementioned scum.

Prior art devices have been provided for holding a soap bar inside of a sponge to facilitate cleaning during bathing or scrubbing. These devices include a chamber centrally located in the interior of the sponge which is designed to receive a bar of soap. Other devices include sponge soap dishes with a soap bar receiving element located thereon. These devices are designed to float in bath water or to stand alone next to a sink or bath.

Thus, while the foregoing body of prior art indicates it to be well known to use sponges in combination with soap bars, the provision of a sponge, designed to envelope a wall mounted soap holder has not been contemplated. Nor does the prior art described above teach or suggest such a sponge, with a generally centrally disposed aperture therein designed to receive the cantilevered portion of the soap dish in combination with a soap bar receiving depression located atop the sponge. Other advantages of the present invention over the prior art also will be rendered evident.

SUMMARY OF THE INVENTION

To achieve the foregoing and other advantages, the present invention, briefly described, provides a sponge which completely surrounds and envelopes a wall mounted soap bar holder or dish. The sponge may include a top portion with a shaped aperture to receive a bar of soap of a generally similar shape. The sponge also includes an opening on one of its sides which would receive the cantilevered element of the soap holder. The opening will extend along the length of the side of the sponge in order to accommodate a similarly sized wall mounted soap bar holder. The opening would extend through a portion of the sponge to fully enclose the wall mounted soap bar holder's cantilevered element. The sponge may be provided in any shape, and preferably may have the appearance of a geometric shape, seashell or animal. The sponge may appear in any color. The sponge material may be provided in a range of porosities depending on size and application. It is recognized that the porosity lattice of the sponge material may effect the mechanical (material) properties of the sponge including tensile strength, ability to withstand cyclical loading, fatigue and general lifetime before degradation. As such, the sponge material will be chosen to maximize material properties while minimizing costs.

For the purposes of this discussion a sponge will be defined as a flexible, hydrophilic, porous member which is generally commercially available as "sponges". Natural sponges found in the oceans may also be utilized with respect to their ability to retain shapes. Rubber sponges or other synthetic sponges will most likely be utilized to carry out the device of the invention.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a sponge covering for a wall mounted soap dish which completely envelopes and surrounds the cantilevered portion of the wall mounted soap dish to prevent the accumulation of soap scum thereon.

It is another object of the present invention is to provide different embodiments of a sponge covering for a wall mounted soap dish which may be employed on any of a variety of wall mounted soap dishes, regardless of the size, shape or design of the soap dish.

Another object of the present invention is to provide a sponge covering for a wall mounted soap dish with a soap bar receiving depression located atop the sponge. The depression may assume any geometric shape to accommodate any like shaped bar of soap. The depression may also be sized to accommodate any like sized bar of soap.

Still a further object of the present invention is to provide a sponge covering for a wall mounted soap dish which may be easily attached to and removed from the soap tray.

Still a further object of the present invention is to provide a sponge covering for a wall mounted soap dish which accumulates soap therein and may, once removed from the dish, be employed as a cleaning device without the need for the use of additional surfactant.

It is another object of the present invention to provide a sponge covering for a wall mounted soap dish which may be easily and efficiently manufactured and marketed.

It is a further objective of the present invention to provide a sponge covering for a wall mounted soap dish which is of durable and reliable construction.

An even further object of the present invention is to provide a sponge covering for a wall mounted soap dish which is susceptible of a low cost of manufacture with regard to both materials and labor, and which accordingly is then susceptible of low prices of sale to the consuming public, thereby making such a sponge covering available to the buying public.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 5 is a view of a second embodiment of the invention showing the sponge just prior to mating a wall mounted soap dish of a second configuration.

DESCRIPTION OF THE PREFERRED EMBODIMENT

With reference now to the drawings, a sponge covering for a wall mounted soap dish embodying the principles and concepts of the present invention will be described.

Figure 1:
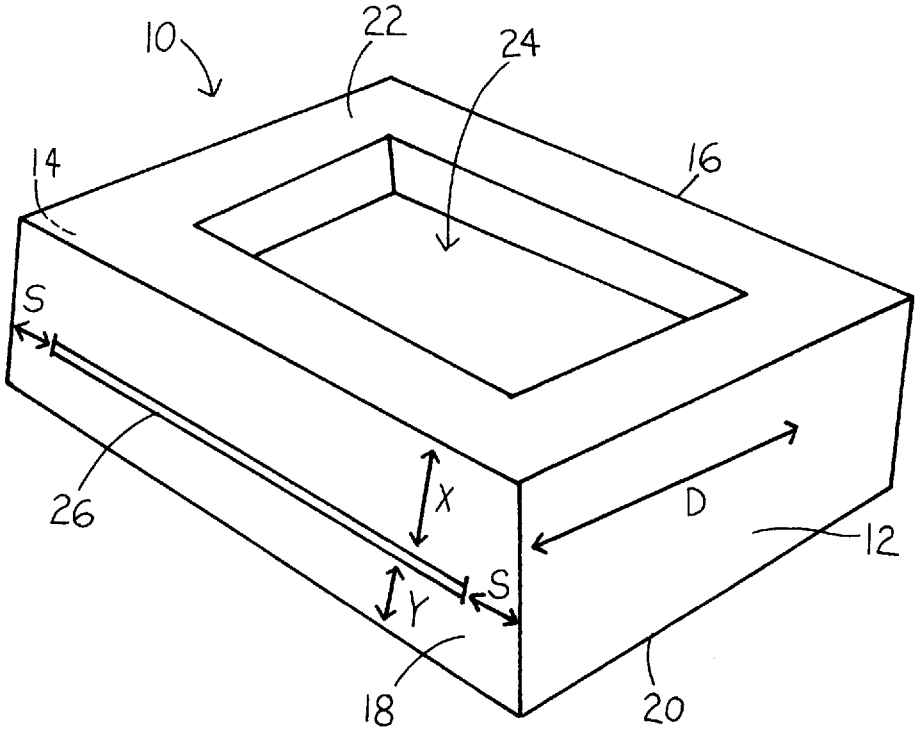
FIG. 1 s a perspective view showing the preferred embodiment of the sponge covering for a wall mounted soap dish of the invention.
Figure 2:
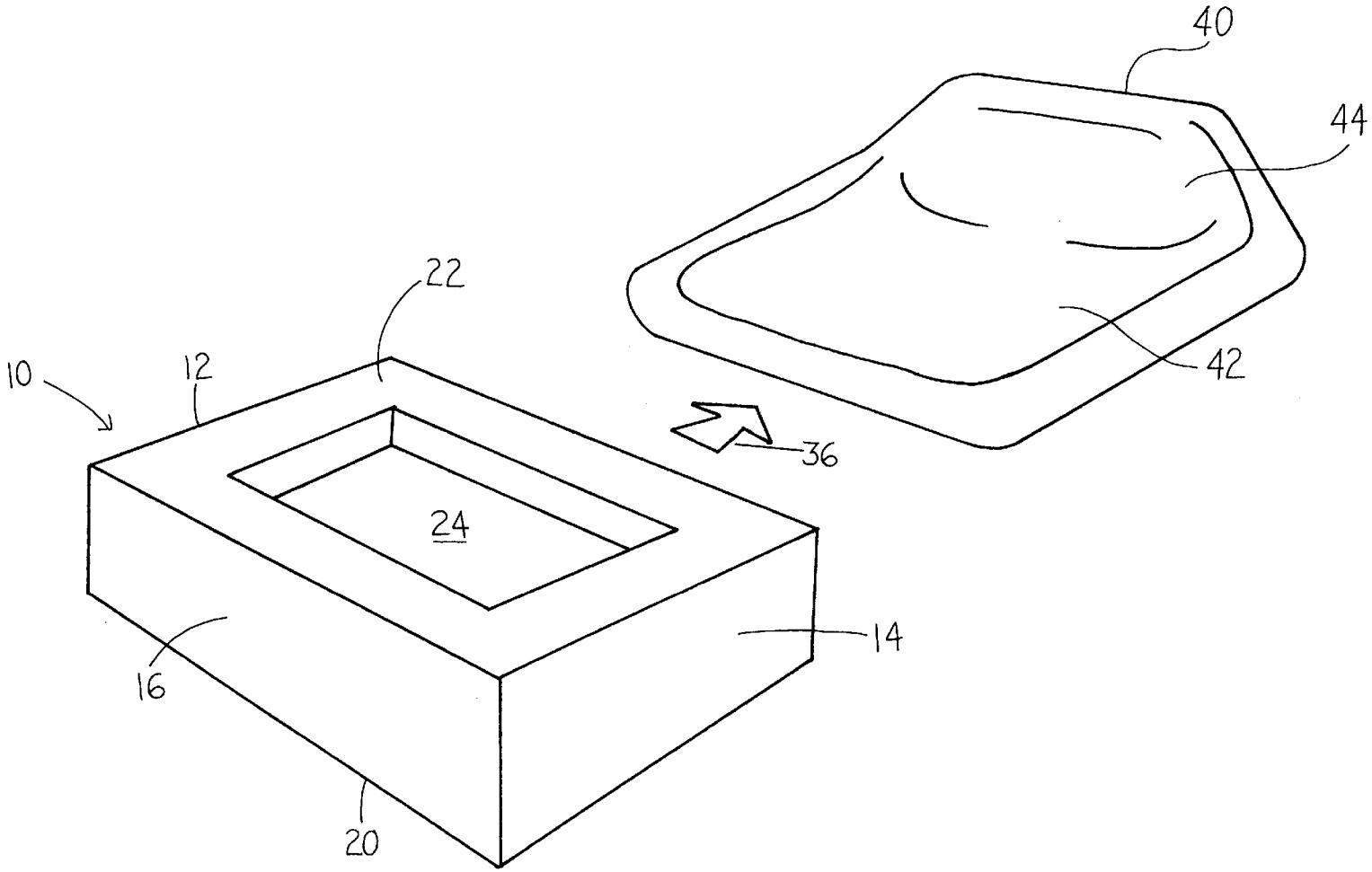
FIG. 2 is a view showing the sponge covering just prior to mating with the wall mounted soap dish.
Figure 3:
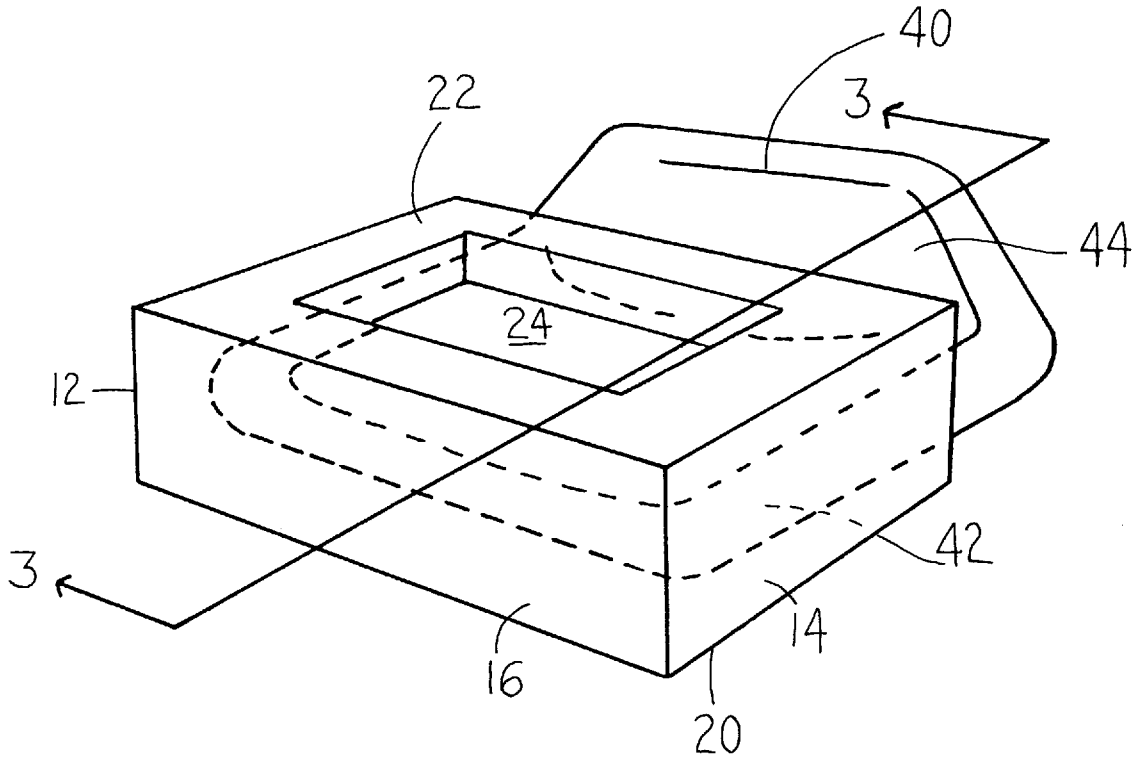
FIG. 3 is a view showing the sponge in a mated configuration with the wall mounted soap dish.

Turning initially to FIGS. 1–3, there is shown a first exemplary embodiment of the sponge covering 10 for a wall mounted soap dish 40. In its preferred form, the sponge covering 10 comprises a generally rectangular sponge element with a first side 12, a second side 14, a front side 16, a rear side 18, a bottom side 20, and a top side 22. In the center of the top side 22 is a cutout 24 which is generally rectangular in this embodiment. An elongated aperture 26 is located on the rear side 18. The elongated aperture 26 will be located a distance X from the top side 22, a distance Y, from the bottom side 20, and a distance S from both the first side 12 and the second side 14. The distances X, Y, and S will be chosen to accommodate the style of wall mounted soap dish 40 the sponge covering 10 will be placed over. In certain embodiments, the distance X may be greater than the distance Y, and in other embodiments, the distance Y may be greater than the distance X. The distance X may also be equal to the distance Y. The distance S will also be chosen to accommodate the wall mounted soap dish 40, and the distance S may be zero in some embodiments. A distance D is also provided which is equal to the depth of the aperture 26 penetration into the sponge covering 10. The distance D will also be chosen to accommodate the wall mounted soap dish 40 the sponge covering 10 will be placed over. These distances X, Y, S, and D, may be selected to be such a dimension to permit the sponge covering 10 to cover most known commercially available or utilized wall mounted soap dishes. These dimensions may also be selected to be such to aid in the commercial manufacture and mass production of the instant invention, as there is a certain uniformity in the dimensions of commercially available wall mounted soap dishes.

The wall mounted soap dish 40 has a generally cantilevered tongue 42 depending from the back plate 44. On the rear of the back plate 44 is a wall mounting means. This wall mounted soap dish 40 is but an example of a dish found near a wash basin or bath. Other configurations for soap dishes exist and it is contemplated that the sponge covering 10 may be designed in such a fashion to permit the covering 10 to be utilized with any dish. This soap dish style is chosen merely to clearly describe a possible embodiment of the instant invention.

Specifically referring to FIG. 2, the sponge covering 10 is shown just prior to placement over the wall mounted soap dish 40. Arrow 36 describes the direction that the sponge covering 10 is being moved in order to surround the cantilevered tongue 42 of the wall mounted soap dish 40.

Specifically referring to FIG. 3, the sponge covering 10 is shown in mating relation with the cantilevered tongue 42 of the wall mounted soap dish 40. Cutout 24 is designed to receive a conventional bar of soap. The cutout 24 may assume the shape of any known soap bar design. It is shown here as being rectangular, however, it is to be understood that the cutout 24 may assume any configuration as soap bars may be manufactured in any configuration.

Figure 4:
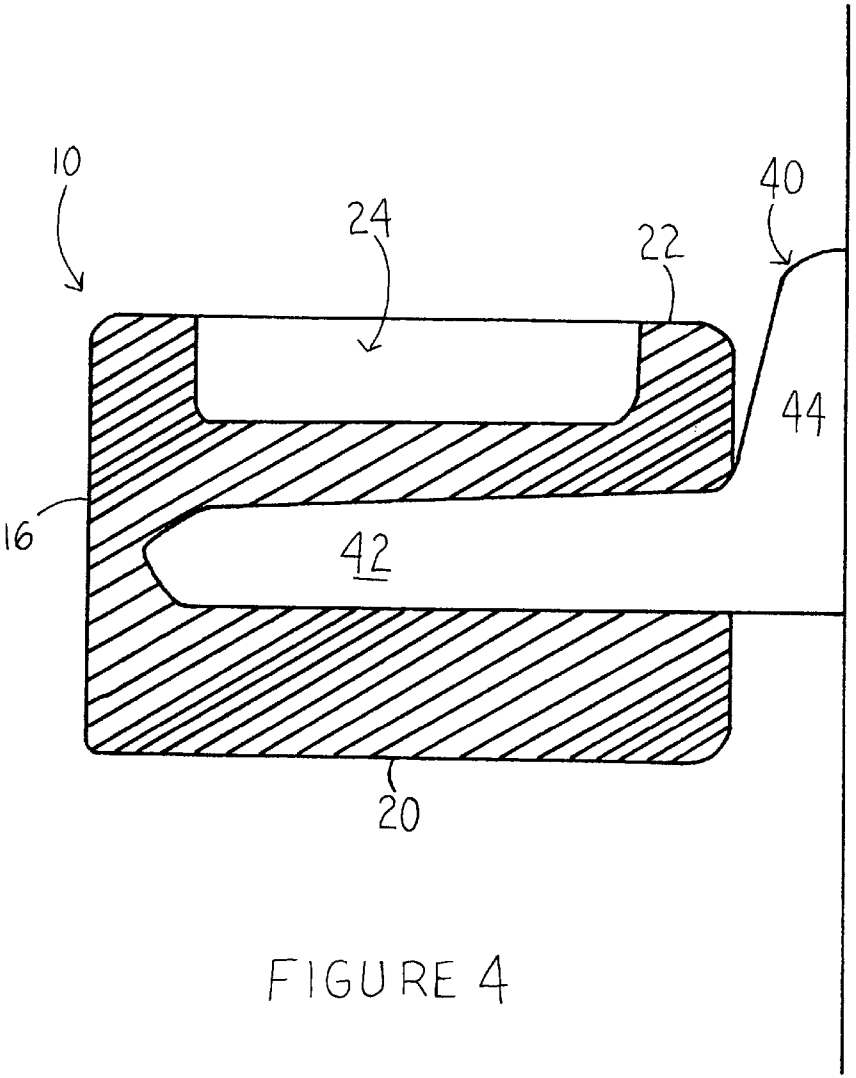
FIG. 4 is a cross-sectional view taken along line 3—3 of FIG. 3.

FIG. 4 is a cross sectional view taken along line 3—3 of FIG. 3. The wall mounted soap dish 40 is shown having the cantilevered tongue 42 being covered by the sponge covering 10. The cutout 24 is substantially above the cantilevered tongue 42. The depth D of the aperture 26 may also be generally inferred from this figure, however, different sized dishes may require different depths D. Generally speaking, D will be chosen to permit cutout 24 to be substantially over the cantilevered tongue 42. The sponge material will grip the cantilevered tongue 42 with sufficient force to permit the sponge covering 10 to be retained in mating relation with the wall mounted soap dish 40 until it is desirous to remove it. During the use of the sponge covering 10 soap suds and soap dissolved in water will permeate the sponge lattice and become entrained therein. When removed and wetted, the sponge covering 10 may become a cleaning device which has soap already present. The sponge covering 10 may also be simply cleaned itself, having all entrained soap removed. The wall mounted soap dish 40 will not have the unsightly soap buildup thereon, and the appearance of the sponge covering 10 may be chosen to be pleasant in both color and design.

Figure 6:
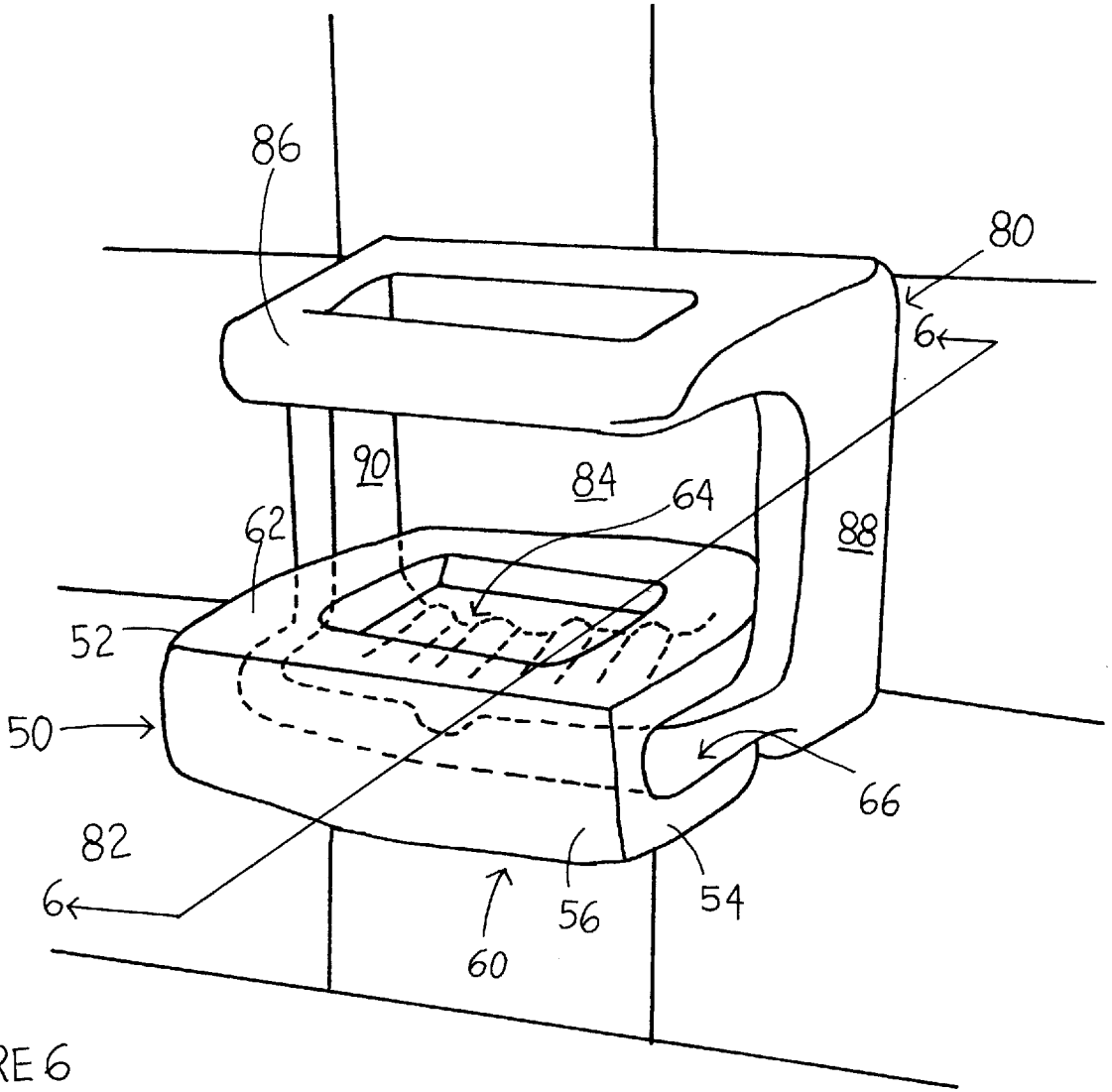
FIG. 6 is a view of the second embodiment of the invention in a mated configuration with the wall mounted soap dish of a second configuration.
Figure 7:
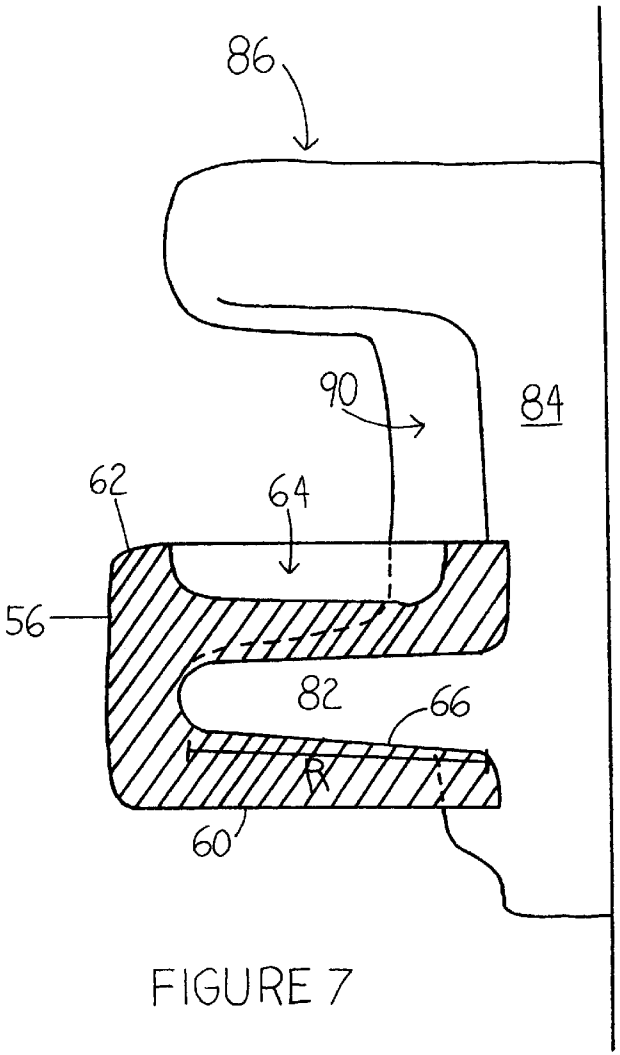
FIG. 7 is a cross-sectional view taken along line 6—6 of FIG. 6.

FIGS. 5–7 show a second embodiment of the invention. A sponge covering 50 for a differently designed wall mounted soap dish 80 is shown. This type of wall mounted soap dish 80 may be found mounted in the wall of a shower stall or mounted to the wall adjoining a bathtub. In this embodiment, the sponge covering 50 comprises a generally rectangular sponge element with a first side 52, a second side 54, a front side 56, a rear side 58, a bottom side 60, and a top side 62. In the center of the top side 62 is a cutout 64 which is generally rectangular in this embodiment. An elongated aperture 66 completely traverses the rear side 58, and extends along the first side 52 and the second side 54.

The wall mounted soap dish 80 has a generally cantilevered tongue 82 depending from the back plate 84. On the rear of the back plate 84 is a wall mounting means. A handle grip 86 is provided above the cantilevered tongue 82. A right side plate 88 and A left side plate 90 connects the handle grip 86 to the cantilevered tongue 82. The right side plate 88, left side plate 90, cantilevered tongue 82, and handle grip 86 are interconnected with the back plate 84 as shown. This wall mounted soap dish 80 is but an example of a dish found near a shower stall or bathtub. Other configurations for soap dishes exist and it is contemplated that the sponge covering 50 may be designed in such a fashion to permit the covering 50 to be utilized with any dish. This soap dish style is chosen merely to clearly describe one possible embodiment of the instant invention.

Specifically referring to FIG. 5, the sponge covering 50 is shown just prior to placement over the wall mounted soap dish 80. Arrow 65 describes the direction that the sponge covering 50 is being moved in order to surround the cantilevered tongue 82 of the wall mounted soap dish 80. The cantilevered tongue 82 is located below handle grip 84. The sponge covering 50 is chosen to be a suitable dimension to permit A bar of soap to be placed in cutout 64 without interference from the handle grip 84. The elongated aperture 66 is shown in an expanded condition about the cantilevered tongue 82. It is to be observed that the first side 52 and the second side 54 reside within the right side plate 88 and the left side plate 90. Other related embodiments include those where other verticle apertures are provided which would permit the sponge covering to reside outside of the right side plate 88 and the left side plate 90.

Referring to FIG. 6, the sponge covering 50 is shown in mating relation with the cantilevered tongue 82 of the wall mounted soap dish 80. Cutout 64 is designed to receive a conventional bar of soap. The cutout 64 may assume the shape of any known soap bar design. It is shown here as being rectangular, however, it is to be understood that the cutout 64 may assume any configuration as soap bars may be manufactured in any configuration.

FIG. 7 is a cross sectional view taken along line 6—6 of FIG. 6. The wall mounted soap dish 80 is shown having the cantilevered tongue 82 being covered by the sponge covering 50. The cutout 64 is located substantially above the cantilevered tongue 82. The depth R of the aperture 66 may also be generally inferred from this figure, however, different sized dishes may require different depths R. Generally speaking, R will be chosen to permit cutout 64 to be substantially over the cantilevered tongue 82. The sponge material will grip the cantilevered tongue 82 with sufficient force to permit the sponge covering 50 to be retained in mating relation with the wall mounted soap dish 80 until it is desirous to remove it. During the use of the sponge covering 50 soap suds and soap dissolved in water will permeate the sponge lattice and become entrained therein. When removed and wetted, the sponge covering 50 may become a cleaning device which has soap already present. The sponge covering 50 may also be simply cleaned itself, having all entrained soap removed. The wall mounted soap dish 50 will not have the unsightly soap buildup thereon, and the appearance of the sponge covering 50 may be chosen to be pleasant in both color and design.

It is easily seen that a variety of different shaped sponge coverings may be provided within the scope of the invention. Some shapes have inherent appeal for the bathroom.

Figure 8:
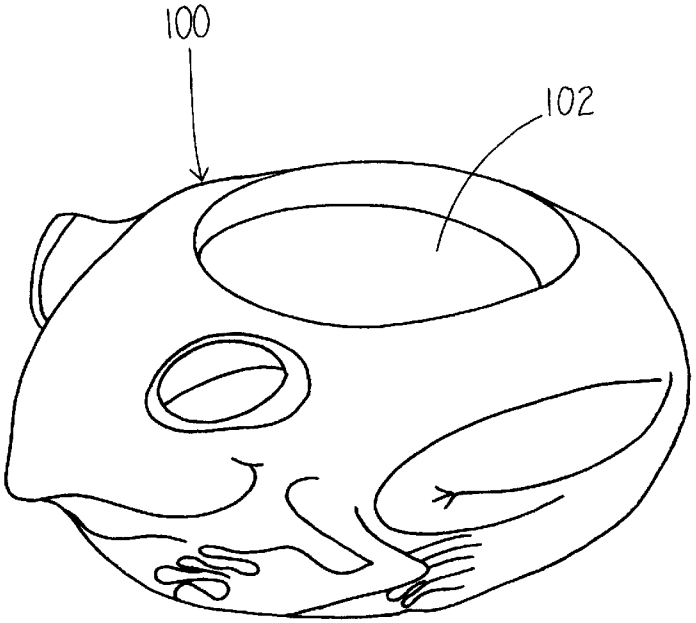
FIG. 8 is a perspective view of a third embodiment of the invention showing a sponge which assumes the appearance of an animal.

As such, FIG. 8 shows a sponge covering 100 which is generally shaped to give the appearance of a frog type amphibian. A circular cutout 102 is provided to receive a bar of soap. As previously discussed, such a cutout may assume any shape or size to receive any shape or size soap bar.

Figure 9:
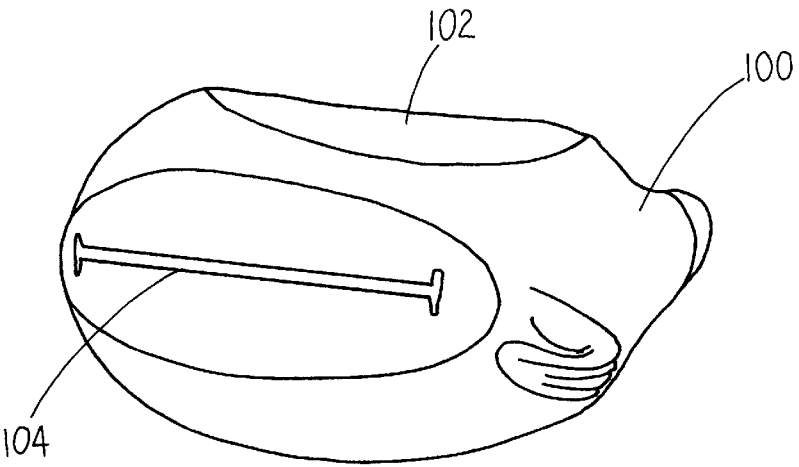
FIG. 9 is a second view of the third embodiment of the invention showing the mating aperture.

FIG. 9 provides a second view of the rear of the sponge covering 100 showing an elongated aperture 104. The elongated aperture 104 extends into the body of the sponge covering 100 and is designed to receive a cantilevered element of a wall mounted soap dish.

Figure 10:
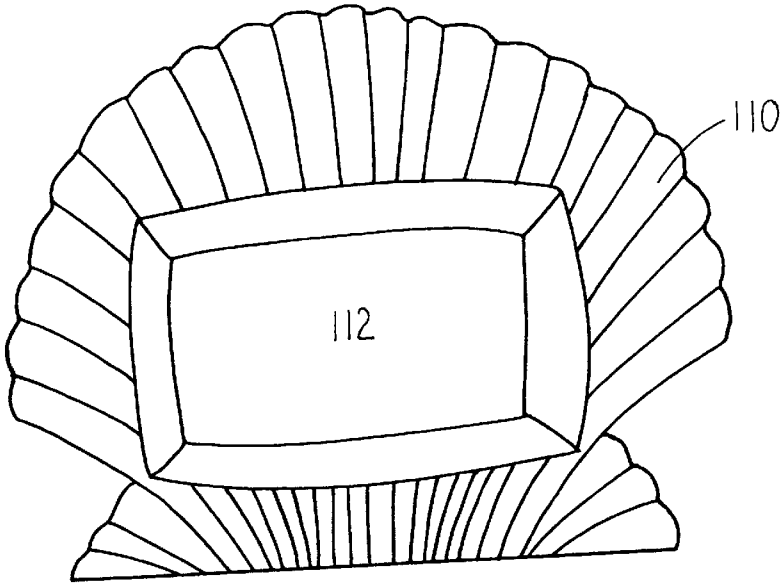
FIG. 10 is a top view of a fourth embodiment of the invention showing a sponge which assumes the appearance of a seashell.

FIG. 10 shows a sponge covering 110 which is generally shaped to give the appearance of a seashell A circular cutout 112 is provided to receive a bar of soap. As previously discussed, such a cutout may assume any shape or size to receive any shape or size soap bar. A variety of seashell species have an appearance which would make them particularly susceptible to be utilized as a sponge covering. These include the bivalves and other mollusks. Some seashells would be preferred due to their shapes, including the cockles and scallops. The Noble Scallop, Chlamys senatoria nobilis and the Heart Cockle, Corculum cardissa have appearances which would make them obvious choices for sponge coverings. This in no way limits the selection to these two species, they are but examples of any of a multitude of seashells which may be employed.

Figure 11:
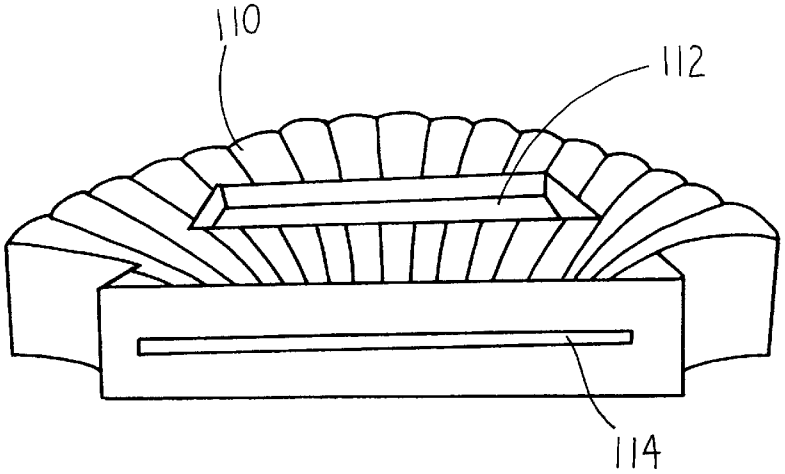
FIG. 11 is a second view of the fourth embodiment of the invention showing the mating aperture.

FIG. 11 provides a second view of the rear of the sponge covering 110 showing an elongated aperture 114. The elongated aperture 114 extends into the body of the sponge covering 110 and is designed to receive a cantilevered element of a wall mounted soap dish.

Although there may be minor modifications made in the depth of the aperture penetration into the body of the sponge covering, the depth of the cutout located atop the body of the sponge covering, as well as other mechanical dimensions, there are a great number of possible configurations possible for the invention. Manufacturing considerations and costs will determine optimum design. Other animals shapes may be provided for the sponge covering, including those giving the appearance of other mollusks, turtles, avians, mammals, fish and amphibians. Other geometric shapes are possible for the sponge covering as well including circular, hexagonal, tetragonal, and octagonal. The sponge covering may take the appearance of cartoon characters or have specific relation to an appearance which appeals to children.

It is apparent from the above that the present invention accomplishes all of the objectives set forth by providing a sponge covering for a wall mounted soap dish including a soap holding cutout. The sponge covering completely envelopes and surrounds the cantilevered portion of the wall mounted soap dish to prevent the accumulation of soap scum thereon. The sponge covering also holds a bar of soap thereon in an aesthetically pleasing fashion.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A sponge covering for a wall mounted soap dish, the soap dish having a cantilevered tongue, said sponge covering comprising:

a body, said body having a top side and a rear side, said rear side having an aperture penetrating into said body, and said top side having a depression centrally located thereon, whereby said aperture is removably mated with the cantilevered tongue of the wall mounted soap dish with said depression oriented in such a fashion as to receive a bar of soap, said covering substantially enclosing the wall mounted soap dish, preventing the accumulation of soap scum thereon.

2. A sponge covering for a wall mounted soap dish having a cantilevered tongue as claimed in claim 1 wherein said body is in the form of a geometric shape selected from the group consisting of a circle, an oval, a square, a rectangle, a tetragon, a pentagon, a hexagon, and an octagon.

3. A sponge covering for a wall mounted soap dish having a cantilevered tongue as claimed in claim 1 wherein said body is in the form of an animal selected from the group consisting of a seashell, a frog, and a turtle.

4. A sponge covering for a wall mounted soap dish having a cantilevered tongue as claimed in claim 1 wherein said depression is in the form of a geometric shape selected from the group consisting of a circle, an oval, a square, a rectangle, a tetragon, a pentagon, a hexagon, and an octagon.

5. A sponge covering for a wall mounted soap dish having a cantilevered tongue as claimed in claim 1 wherein said aperture is about centrally located on said rear side.

6. A sponge covering for a wall mounted soap dish having a cantilevered tongue as claimed in claim 1 wherein said body further includes a first side and a second side, said first side in parallel relation to said second side, said rear side intermediate said first and second side, said aperture extending the length of rear side and penetrating into said body and extending onto said first side and said second side.

7. A sponge covering as claimed in claim 1 wherein said covering may assume any color.

8. A seashell shaped sponge covering for a wall mounted soap dish comprising:

a seashell shaped body, said body having a top side and a rear side, said rear side having an aperture penetrating into said body, and said top side having a depression centrally located thereon, whereby when said aperture is mated with the soap dish, said covering substantially encloses the soap dish with said depression oriented in such a fashion as to receive a bar of soap, thereby preventing the accumulation of soap scum directly on the soap dish.

9. A seashell shaped sponge covering for a soap dish as claimed in claim 8 wherein said body assumes the shape of any of the species of scallops.

10. A seashell shaped sponge covering for a soap dish as claimed in claim 8 wherein said body assumes the shape of any of the species of cockles.

11. A covering for a wall mounted soap dish comprising:

a body, said body having a top side and a rear side, said rear side having an aperture penetrating into said body, and said top side having a depression centrally located thereon, whereby said aperture is mated with the wall mounted soap dish with said depression oriented in such a fashion as to receive a bar of soap.

12. A covering for a soap dish as claimed in claim 11 wherein said body includes hydrophilic material.

13. A covering for a soap dish as claimed in claim 12 wherein said hydrophilic material is flexible.

14. A covering for a soap dish as claimed in claim 13 wherein said hydrophilic material includes synthetic sponge.

15. A covering for a soap dish as claimed in claim 13 wherein said hydrophilic material includes rubber sponge.

16. A covering for a soap dish as claimed in claim 12 wherein said hydrophilic material includes synthetic sponge.

17. A covering for a soap dish as claimed in claim 12 wherein said hydrophilic material includes natural sponge.

* * * * *